US005666981A

United States Patent [19]

Stephens

[11] Patent Number: 5,666,981

[45] Date of Patent: Sep. 16, 1997

[54] EMERY BOARD UTILIZING ACETONE BASED ADHESIVE

[76] Inventor: Dallas H. Stephens, 1117 Ayers Ave., Ojai, Calif. 93023

[21] Appl. No.: 489,481

[22] Filed: Jun. 12, 1995

Related U.S. Application Data

[63] Continuation-in-part of Ser. No. 348,292, Dec. 2, 1994, abandoned.

[51] Int. Cl.[6] ..... A45D 29/18

[52] U.S. Cl. ..... 132/76.4

[58] Field of Search ..... 132/76.4, 76.5

[56] References Cited

U.S. PATENT DOCUMENTS

| | | | |
|---|---|---|---|
| 2,308,624 | 1/1943 | Pouech | 132/76.4 |
| 3,653,859 | 4/1972 | Zimmer, Jr. et al. | 51/401 |
| 4,034,769 | 7/1977 | Nishimura | 132/76.4 |
| 4,572,222 | 2/1986 | Pangburn | 132/76.4 |
| 4,621,465 | 11/1986 | Pangburn | 132/76.4 |
| 5,176,155 | 1/1993 | Rudolph, Jr. | 132/76.4 |
| 5,287,863 | 2/1994 | La Joie et al. | 132/76.4 |

*Primary Examiner*—Todd E. Manahan

*Attorney, Agent, or Firm*—Jack C. Munro

[57] ABSTRACT

An emery board which is constructed of a core material which includes a single layer of foam. Adhesively secured directly to that layer of foam is an abrasive layer. The adhesive is not alcohol based but acetone based. The abrasive layer comprises a mass of abrasive particles.

4 Claims, 1 Drawing Sheet

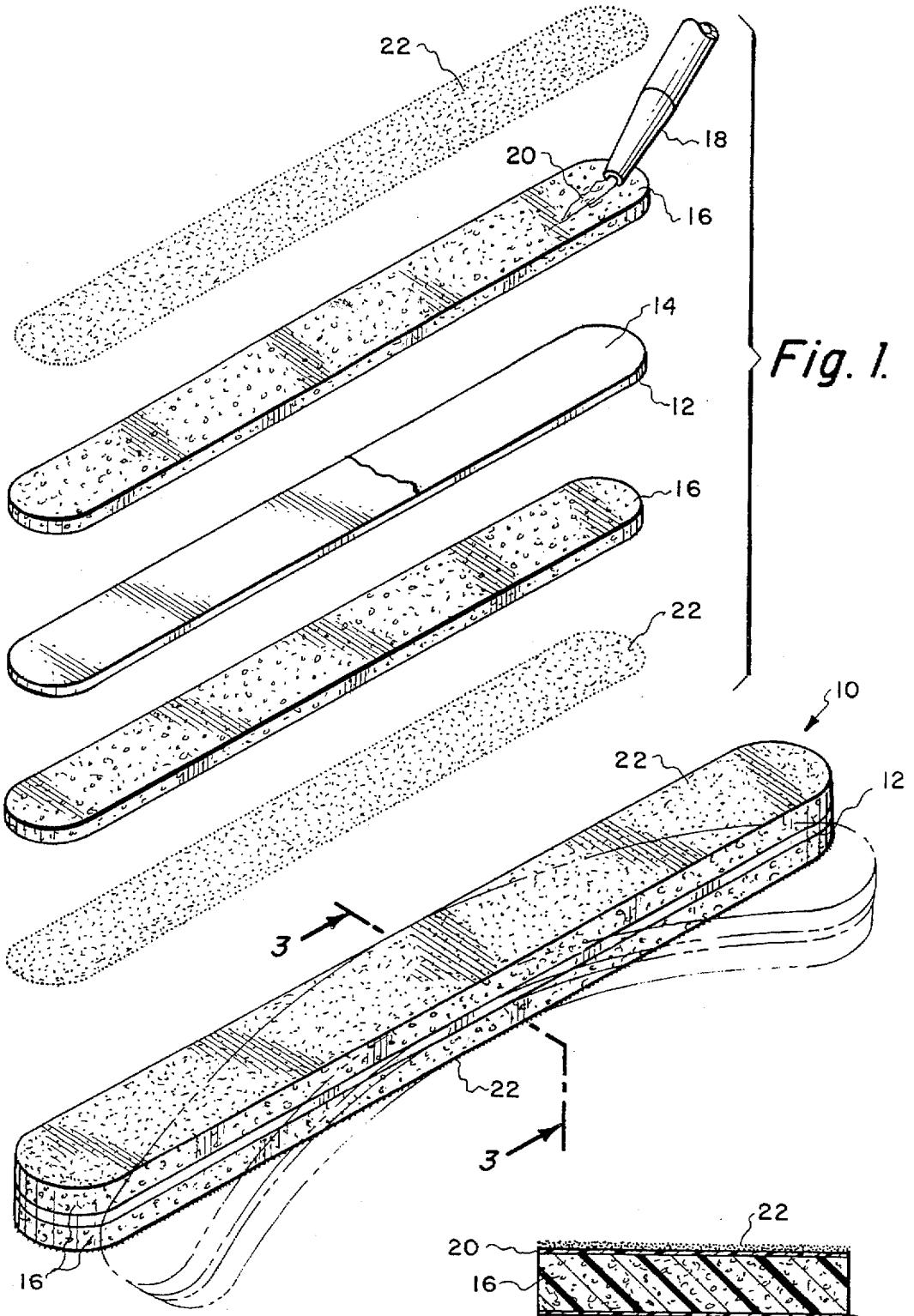
Fig. 1.
Fig. 2.
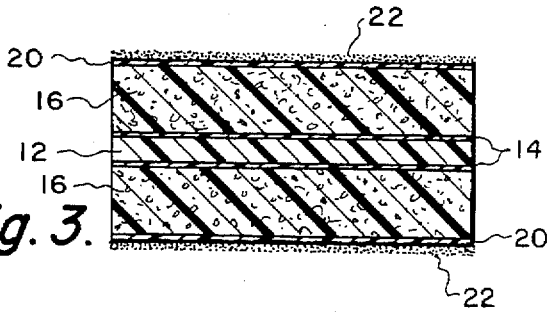
Fig. 3.

EMERY BOARD UTILIZING ACETONE BASED ADHESIVE

REFERENCE TO PRIOR APPLICATION

This patent application is a continuation-in-part of patent application Ser. No. 08/348,292, filed Dec. 2, 1994, by the same title and same inventor, now abandoned.

BACKGROUND OF THE INVENTION

1) Field of the Invention

The field of this invention relates to constructing of an emery board.

2) Description of the Prior Art

A common product manufactured from sandpaper is an emery board. Typically an emery board has a core which is rigid with this core being formed of wood, metal, paper, plastic or foam. Attached to this core on opposite sides thereof is a layer of sandpaper. The sandpaper is normally paper upon which has been adhesively secured abrasive media. These emery boards are generally manufactured of a width between ½ inch and one inch and have a length between three and seven inches.

Prior art emery boards have not been readily flexible. It is very easy during usage of the board that the board becomes flexed enough to actually break and form a crack in the sandpaper layer. This crack makes the emery board substantially not usable.

Also, prior art emery boards, because of their rigidity, have not been able to be used effectively on the nail plate. The reason for this is that the nail plate is arcuate and the emery boards are straight. The emery board, because of its rigidity, does not conform to the arcuate surface of the nail plate. Usage of an emery board adjacent the cuticle area of the nail on the nail plate would be desirable.

Because emery boards in the past have used layers of paper to support the abrasive layer, it is exceedingly common for a user to receive a paper cut. A paper cut at the tip of one's finger or cuticle cannot only be annoying but can also be very painful.

Professional manicurists are now being directed by state boards of cosmetology to sanitize emery boards that are used for more than one customer. The typical method of sanitization of an emery board is to soak the emery board in a sanitizing solution. A typical sanitizing solution would be alcohol. Emery boards in the prior art have been constructed including adhesive layers which are also alcohol based. Therefore, immersing of the emery board in the alcohol type of solvent will eventually cause destruction of the board. There is a need to construct an emery board of an adhesive that is not alcohol based so that the emery board can be readily sanitized by an alcohol solution or similar solvent.

Also, because prior art emery boards have been constructed of paper layers upon which abrasives have been coated, those paper layers are an effective insulator of heat. At times the professional manicurist will produce a significant amount of heat in an emery board. If this heat is not quickly dissipated, that heat may be sufficient to cause a minor burn. The paper layers within the emery board retard the dissipation of such heat and thereby increase the possibility of burns to the user.

SUMMARY OF THE INVENTION

An emery board which is constructed of a core which has a center member formed of a thin sheet-material such as plastic. This plastic is readily bendable and actually can be bent almost 180 degrees on itself without breaking. Adhesively secured on each side of the plastic is a thin layer of foam. Adhesively secured on the exposed outer surface of each layer of foam is an abrasive media layer such as sand particles. The adhesive used is not alcohol based but generally is acetone based.

The primary objective of the present invention is to construct an emery board which can be readily flexed into practically any position and where the abrasive layer will not be caused to form any cracks.

Another objective of the present invention is to construct an emery board which is readily deformable and flexible so that it will conform to any desired shape upon which it is used such as the arcuate nail plate of a fingernail.

Another objective of the present invention is to construct a emery board which includes adhesive layers that are not alcohol based so that the emery board can be readily sanitized by being immersed in a alcohol solution.

Another objective of the present invention is to construct an emery board which has a substantially extended life compared to conventional emery boards.

Another objective of the present invention is to construct an emery board that does not include paper layers thereby eliminating the possibility of a paper cut being obtained during usage of the board.

Another objective of this invention is to construct an emery board that does not include paper which would hinder sanitizing because paper absorbs the sanitizing solution.

BRIEF DESCRIPTION OF TEE DRAWING

FIG. 1 is an exploded isometric view of the different layers of the emery board of the present invention;

FIG. 2 is an isometric view showing the emery board in its completely constructed configuration depicting its flexibility in phantom lines; and FIG. 3 is a cross-sectional view taken along line 3—3 of FIG. 2.

DETAILED DESCRIPTION OF THE PREFERRED EMBODIMENT

Referring particularly to the drawing there is shown an emery board 10 which is constructed of a center plastic layer 12. On the exterior surfaces of the plastic layer 12 there is applied a thin layer of adhesive 14. This adhesive is not alcohol based, but is acetone based. The reason for this is that the emery board 10 can then be readily immersed within an alcohol base sanitizing solution and remain in that solution for a period of time with the adhesive not being broken down by the alcohol and the board 10 thereby remaining intact. Instead of alcohol, dimethyl benzyl ammonium chloride could be used. Acetone would break down the adhesive. However, acetone is normally not used as a sanitizer since it is carcinogenic. The adhesive 14 is applied from a supply of adhesive contained within a tool 18.

Secured to each layer of adhesive 14 is a foam layer 16 with it being understood that there are two separate foam layers 16. Typical material for the foam layer 16 would be plastic closed cell foam that is readily compressible. Adhesively secured by adhesive layers 20 to the exterior surface of the foam layers 16 is an abrasive media layer 22. Typical material for the abrasive media layer 22 would be a mass of individual abrasive particles called grit. Typical grit would be sand, silicon-carbide particles, aluminum oxide particles, garnet particles and/or glass particles. Once the adhesive 20 is applied to the exterior surfaces of the foam layers 16, the grit is sprinkled onto and completely covering adhesive 20. Once the adhesive is dried, the emery board 10 is now ready for use upon being cut into the desired length and shape such as is shown in the drawing. Normally the emery board 10 would be constructed from a substantially wide and substantially long sheet. The emery boards 10 would then be cut by a die from this sheet.

Not only is the emery board capable of being readily flexed as is generally depicted in dotted lines in FIG. 2, but when pressure is applied to the abrasive surfaces 22, those abrasive surfaces 22 will readily deform by compressing the foam layers 16. This compressibility permits usage of the emery board 10 not only at the edge of a human fingernail but also on top of the nail plate. The nail plate is generally arcuate or mounded and this compressibility conforms the emery board 10 to the nail plate thereby applying the grit of the applying layer 22 more uniformly across the surface of the nail plate. This conforming ability gives at least one hundred percent increase in the area being sanded as opposed to a prior art emery board.

Also during usage of the emery board 10 of this invention, the grit of the applying abrasive layer 22 will slightly deflect under the application of pressure into the direction of the foam layer 16. This deflection results in a superior finish especially when used on the nail plate when compared to prior art emery boards. The emery board 10 of this invention works well in the cuticle area of the nail plate which with prior emery boards has not been possible.

A professional can use the emery board 10 of this invention extensively and with great rapidity and any heat that is generated is readily dissipated into the foam thereby eliminating the possibility of any slight burn to the user.

What is claimed is:

1. An emery board comprising:

a core including a thin sheet material first layer of foam, said first layer of foam having a first exterior surface; and a first abrasive media layer being directly adhesively secured to said exterior surface by an adhesive, said first abrasive media layer being composed of a mass of small abrasive particles, whereby said emery board can be readily flexed without creating cracks in said abrasive layer, said adhesive being acetone based thereby permitting use of alcohol as a sanitizing solution by soaking of said emery board with said emery board remaining intact since said adhesive is not dissolved.

2. The emery board as defined in claim 1 wherein:

said core further including a sheet material plastic layer, said plastic layer having an upper surface and an lower surface, said first layer of foam being secured to said upper surface by said adhesive.

3. The emery board as defined in claim 2 wherein:

there being a second layer of foam in said core, said second layer being adhesively secured to said lower surface of said plastic layer by said adhesive, said second layer of foam having a second exterior surface.

4. The emery board as defined in claim 3 wherein:

a second abrasive layer being directly adhesively secured to said second exterior surface, said second abrasive layer being composed of a mass of small abrasive particles.

* * * * *